US007104858B1

(12) United States Patent
Yonover

(10) Patent No.: US 7,104,858 B1
(45) Date of Patent: Sep. 12, 2006

(54) EMERGENCY SUPPLEMENTAL FLOTATION DEVICE

(76) Inventor: Robert N. Yonover, 219 Koko Isle Cir., Suite 602, Honolulu, HI (US) 96825

( * ) Notice: Subject to any disclaimer, the term of this patent is extended or adjusted under 35 U.S.C. 154(b) by 500 days.

(21) Appl. No.: 10/292,461

(22) Filed: Nov. 13, 2002

(51) Int. Cl.
*B63C 9/08* (2006.01)

(52) U.S. Cl. ..... 441/106; 441/114

(58) Field of Classification Search ..... 441/106, 441/114, 20
See application file for complete search history.

(56) References Cited

U.S. PATENT DOCUMENTS 1,289,123 A * 12/1918 Decowski ..... 441/106
1,508,274 A * 9/1924 De Mattia ..... 441/114
2,619,303 A * 11/1952 Martin ..... 244/33
3,279,419 A * 10/1966 Demarco ..... 116/210
5,030,153 A * 7/1991 Bailey ..... 441/115
5,536,191 A * 7/1996 Lin ..... 441/89
5,820,431 A * 10/1998 Biesecker ..... 441/94
5,954,556 A 9/1999 Powers
6,158,380 A 12/2000 Aschauer et al.
6,537,119 B1 * 3/2003 Deslauriers ..... 441/106

* cited by examiner

*Primary Examiner*—Stephen Avila
(74) *Attorney, Agent, or Firm*—Shlesinger, Arkwright & Garvey LLP

(57) ABSTRACT

Personal flotation device comprises an inflatable spheroid balloon and a strap secured to said balloon. The strap includes a loop into which a person's arm, leg or upper body may be slipped.

34 Claims, 3 Drawing Sheets

EMERGENCY SUPPLEMENTAL FLOTATION DEVICE

FIELD OF THE INVENTION

The present invention relates generally to a personal flotation device and specifically to an emergency supplemental flotation device that is compact enough when stowed to keep in a person's pocket.

BACKGROUND OF THE INVENTION

Military personnel commonly find themselves at the edge of a ship/boat without proper flotation equipment for a variety of reasons (e.g., cigarette break, fresh-air break, etc.). The risk of inadvertently going overboard is unfortunately high. Once in the water, the person must stay afloat until someone notices them missing and initiates a Search and Rescue (SAR) effort to extract them from the extreme conditions at sea.

OBJECTS AND SUMMARY OF THE INVENTION

It is an object of the present invention to provide an emergency supplemental flotation device designed as a back-up flotation means for persons that find themselves in the water without the proper survival equipment.

It is another object of the present invention to provide an emergency supplemental flotation device that is sufficiently compact to fit into a shirt pocket and can be manually deployed to provide a person with the minimum required level of flotation for an extended period of time until help can arrive.

In summary, the present invention provides a personal flotation device, comprising an inflatable spheroid balloon and a strap secured to the balloon. The strap includes a loop into which a person's arm, leg or upper body may be slipped.

The present invention also provides a personal flotation device, comprising first and second inflatable spheroid balloons; and a strap with first and second ends secured to respective said first and second balloons. The strap has a length sufficient to be placed across a user's upper chest and slipped underneath each armpit such that the balloons are disposed behind the shoulders of the user.

The present invention further provides a personal flotation device, comprising first and second inflatable spheroid balloons; first and second straps secured to respective first and second balloons; and a leg harness secured to the first and second straps. The first and second straps have sufficient lengths to keep the user's head above water.

The present invention also provides a method for keeping a person afloat in water, comprising providing first and second inflatable spheroid balloons having a strap with its first and second ends secured to the respective first and second balloons; and disposing the strap across the person's front upper chest and underneath each armpit such that the balloons are disposed behind the person's shoulders. The strap may be also disposed across the person's crotch.

The present invention further provides a method for keeping a person afloat in water, comprising providing an inflated spheroid balloon having a strap with a loop attached thereto; and slipping the person's arm, leg or upper body into the loop.

These and other objects of the present invention will become apparent from the following detailed description.

BRIEF DESCRIPTIONS OF THE DRAWINGS

DETAILED DESCRIPTION OF THE INVENTION

Figure 1:
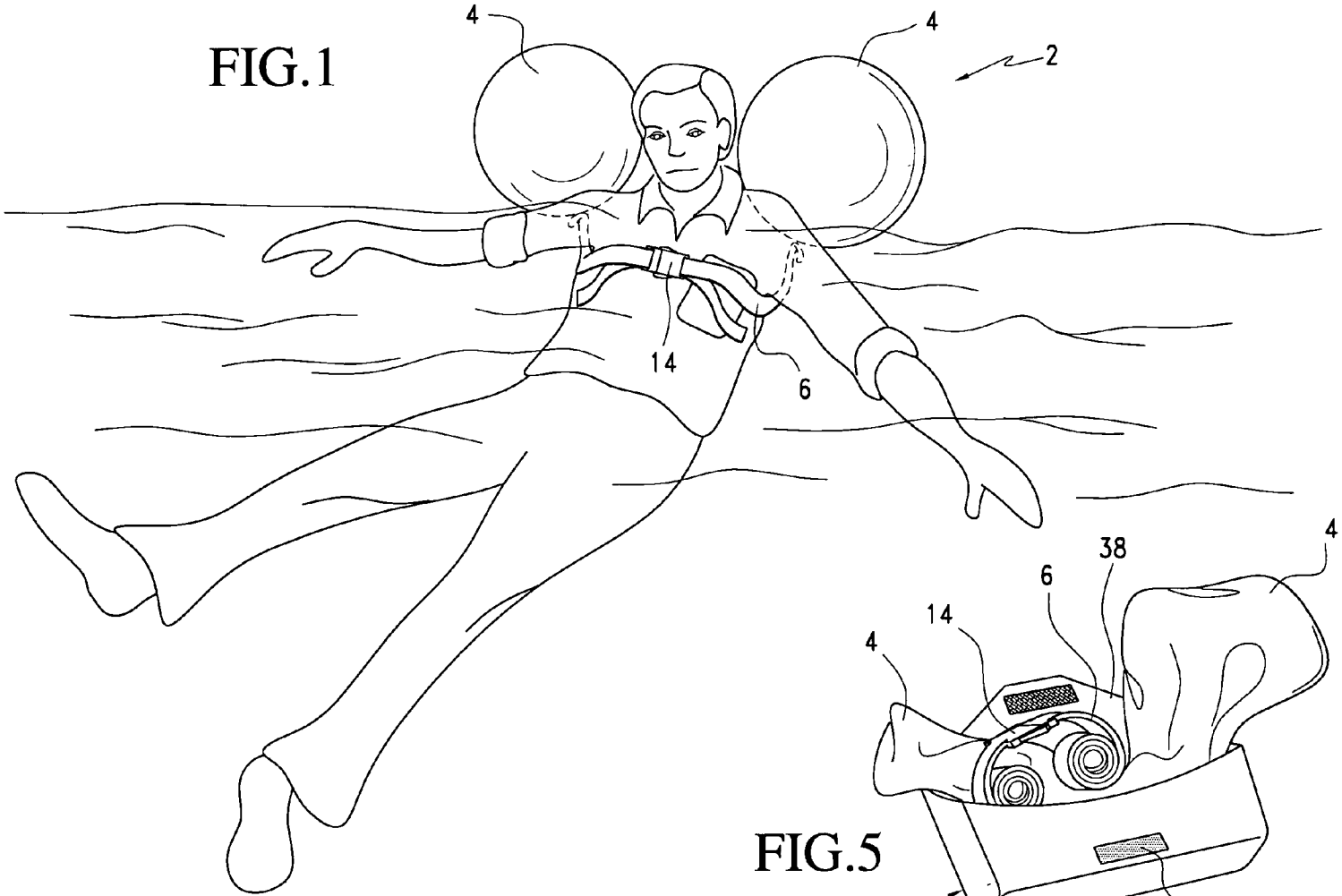
FIG. 1 is a perspective view of an emergency supplemental flotation device made in accordance with the present invention, shown being used by a person in the water.
Figure 5:
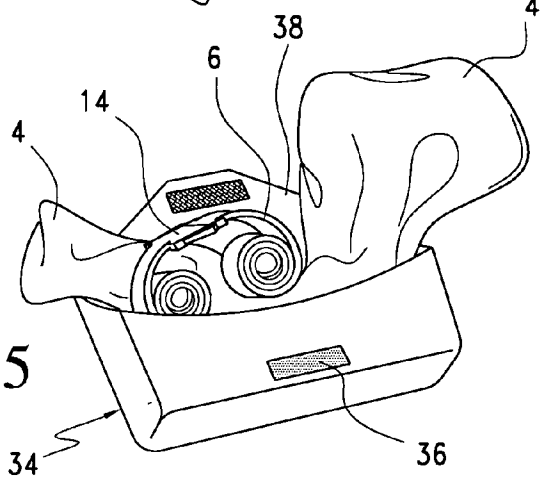
FIG. 5 is a perspective view of the device of FIG. 2 shown deflated and being stowed in a small pouch.

An emergency supplemental flotation device 2 made in accordance with the present invention is disclosed in FIG. 1 as it is being used by a person in the water. The flotation device 2 comprises a pair of balloons 4 joined together by means of a strap 6 disposed across the person's front chest and underneath his armpits. The balloons are disposed behind the person's shoulders. The device 2 is securely held to the person's body without requiring any manual intervention from the person. The balloons 4 are preferably spheroid in shape for optimum performance in open water conditions such as that found in ocean or lakes. The spheroid balloons advantageously provide a stable shape especially in its ability to withstand wind and water forces, which are dissipated over the entire curve surface area, reducing the forces on any one point and minimizing the possibility of rapturing the balloons. The spheroid balloon is also highly visible on the surface of the water, providing an added safety feature, specially when pigmented with a brilliant color, such as the standard the Coast Guard orange.

Each balloon 4 has a neck portion 8 to which the strap 6 is secured in a conventional manner. Each neck portion 8 can be a tube which communicates with the interior of the balloon 4 to function as an air inlet for orally inflating the balloon. Preferably, each balloon is provided with a separate inlet valve 10, in which case, the neck portion 8 is merely used to secure the strap to the balloon. Other means for securing the strap to the balloon would be apparent to a person skilled in the art.

The strap 6 has two pieces 12 joined together by a buckle 14. The buckle 14 allows the length of each piece 12 to be shortened or lengthened, thereby providing an adjustment to the total length of the strap 6. This advantageously provides for the proper fit and flotation level for the user, since people have different body sizes and densities and therefore need to attach the balloons 4 at different levels under the arm and around the chest area in order to provide the optimum flotation position. The buckle 14 is advantageously disposed on the front chest of the user for convenient access when adjustment is desired to the length of the strap 6. Other means for providing adjustability to the strap may be used.

The balloons 4 may be colored with brilliant flourescent colors for daytime visibility and/or phosphorescent pigments to provide a night time signature to search and rescue crafts. By making one of the balloons flourescent colored and the other one phosphorescent, both day and nights visibility will be optimized. Metallic materials, such as MYLAR-type material, can also be incorporated into the balloons to facilitate radar reflectivity.

Utilizing two balloons advantageously provide redundancy. If one of the balloons is punctured, the user can still float from the buoyancy provided by the remaining balloon. Further, the two balloons together provide a larger footprint that will be more readily spotted by a passing ship or a water-based search and rescue mission. Aircrafts at lower altitude may also be able to see the two balloons.

Figure 3:
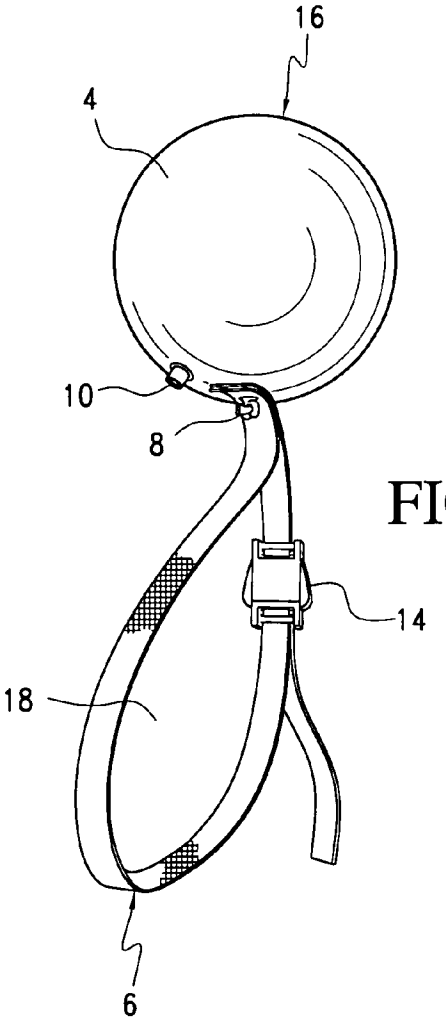
FIG. 3 is a perspective view of another embodiment of an emergency supplemental flotation device.

A single spheroid balloon embodiment of an emergency supplemental flotation device 16 is disclosed in FIG. 3. The strap 6 forms a loop 18 into which the user's arm, leg or upper body may be slipped. The buckle 14 advantageously provides an adjustability to the size of the loop 18 to provide the optimum flotation position for the balloon 4.

Figure 4:
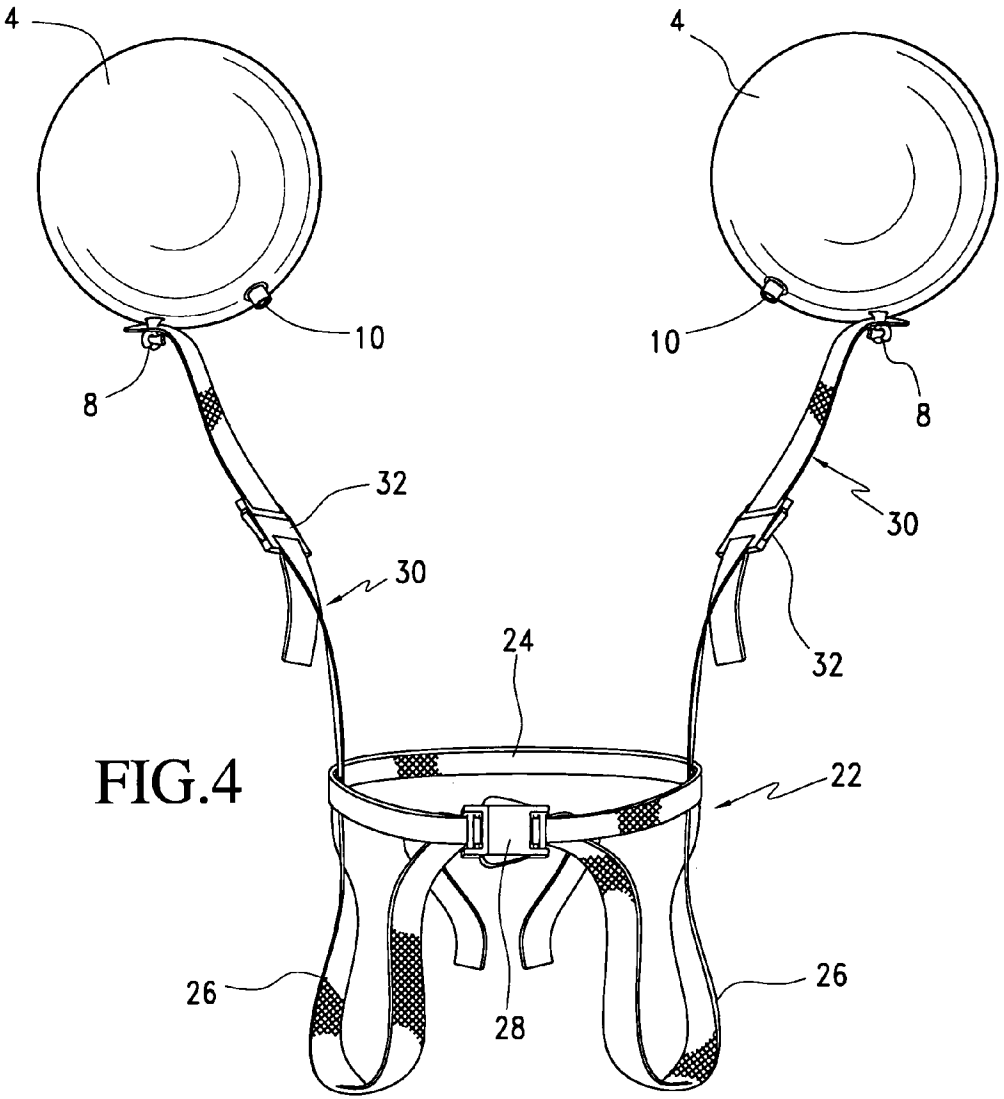
FIG. 4 is a perspective view of yet another embodiment of an emergency supplemental flotation device.

Another embodiment of an emergency supplemental flotation device 20 is disclosed in FIG. 4. The device 20 includes the two balloons 4 tied to a leg harness 22. The leg harness 22 includes a belt 24 adapted to go around the person's waist. Loops 26 are secured to the belt 24 and are adapted for the person's respective legs to slip into. A buckle 28 secures the belt 24 around the user's waist. Straps 30 secure the respective balloon 4 in a standard manner as previously described with the device 2 embodiment. Each of the straps 30 includes a buckle 32 to allow the user to adjust the height of the balloon 4 for optimum flotation position.

The various embodiments of the emergency supplemental flotation device may be stowed in a compact flexible case 34 which can be carried in or attached to a person's shirt pocket, such as that in a standard issue ship deck uniform. VELCRO fastener 36 is provided for the closure flap 38. By integrating the emergency supplemental flotation device into the shirt pocket, sailors will always be equipped with a back-up flotation means, regardless of their action or location on the ship. Once the sailor finds himself inadvertently in the water, the flotation device can be removed from his shirt pocket for manual inflation and deployment. The balloons are then orally inflated. Sailors equipped with the flotation device of the present invention will significantly increase their chances of surviving an accidental fall overboard.

Figure 2:
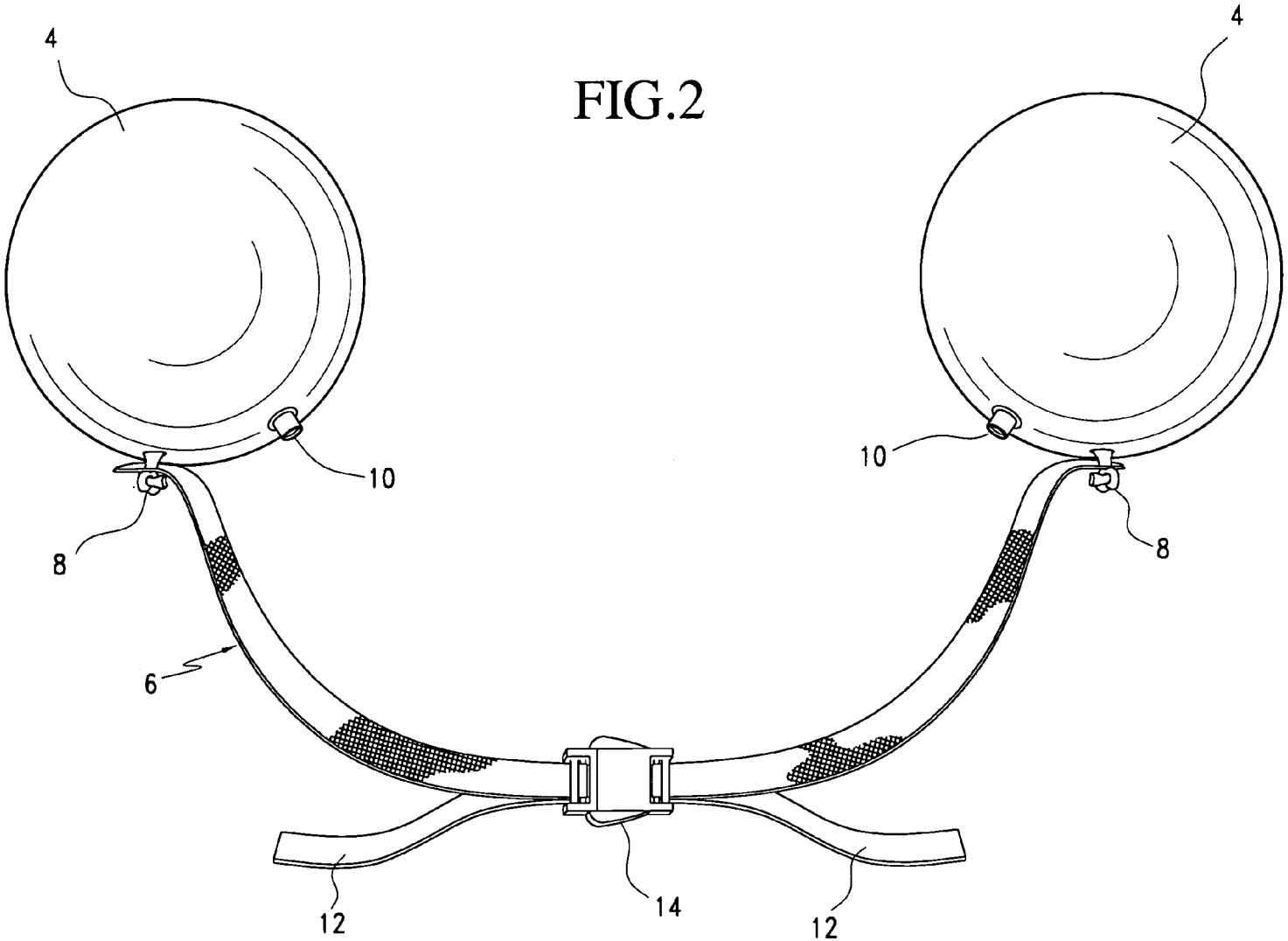
FIG. 2 is a perspective view of the device shown in FIG. 1.

In the two-balloon embodiments of FIGS. 2 and 4, symmetrical support is advantageously provided.

The balloons are advantageously UV-resistant to withstand extended periods of stowage, followed by inflation and use in extreme ocean conditions. The pouch 34 can be a simple vacuum sealed package.

The emergency supplemental flotation device of the present invention is advantageously compact in order for it to fit into a pocket or other small storage area on the person. In this manner, the person is provided at least a bare minimum level of emergency flotation, since most people would not wear a life jacket. The pouch 34 can be as small as one's palm.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. Personal flotation device, comprising:
a) an inflatable spheroid balloon;
b) a strap directly secured to said balloon;
c) said strap including a loop into which a person's arm, leg or upper body may be slipped.

2. Personal flotation device as in claim 1, wherein said strap is adjustable in length.

3. Personal flotation device as in claim 1, wherein:
a) said strap includes first and second lengths; and
b) a buckle to join said first and second lengths together.

4. Personal flotation device as in claim 1, wherein:
a) said balloon includes a neck portion; and
b) said strap is secured to said neck portion.

5. Personal flotation device as in claim 4, wherein said neck portion communicates with the interior of said balloon such that said balloon is inflated through said neck portion.

6. Personal flotation device as in claim 1, wherein said balloon includes an inlet valve to inflate said balloon.

7. Personal flotation device as in claim 1, wherein:
a) said balloon includes a neck portion;
b) said strap is secured to said neck portion; and
c) said balloon includes an inlet valve to inflate said balloon.

8. Personal flotation device as in claim 1, wherein said balloon is adapted for oral inflation.

9. Personal flotation device as in claim 1, and further comprising a pouch for storing said balloon when deflated and said strap in a person's pocket.

10. Personal flotation device as in claim 1, wherein said balloon is brightly colored.

11. Personal flotation device as in claim 1, wherein said balloon includes light reflective pigments.

12. Personal flotation device as in claim 1, wherein said balloon is covered with metallic materials.

13. Personal flotation device, comprising:
a) first and second inflatable spheroid balloons;
b) a strap with first and second ends directly secured to respective said first and second balloons; and
c) said strap having a length sufficient to be placed across a user's upper chest and slipped underneath each armpit such that said balloons are disposed behind the shoulders of the user.

14. Personal flotation device as in claim 13, wherein said strap is adjustable in length.

15. Personal flotation device as in claim 13, wherein:
a) said strap includes first and second lengths; and
b) a buckle to join said first and second lengths together.

16. Personal flotation device as in claim 13, wherein:
a) said first and second balloons each includes a neck portion; and
b) said first and second ends are secured to respective said neck portion.

17. Personal flotation device as in claim 16, wherein said neck portion communicates with the interior of said balloon such that said balloon is inflated through said neck portion.

18. Personal flotation device as in claim 13, wherein said first and second balloons each includes an inlet valve to inflate said respective balloon.

19. Personal flotation device as in claim 13, wherein:
a) said first and second balloons each includes a neck portion;
b) said first and second ends are secured to respective said neck portion; and
c) said first and second balloons each includes an inlet valve to inflate said respective balloon.

20. Personal flotation device as in claim 13, wherein said first and second balloons are brightly colored.

21. Personal flotation device as in claim 13, wherein:
a) said first balloon includes light reflective pigments; and
b) said second balloon is brightly colored.

22. Personal flotation device as in claim 13, wherein said first balloon includes metallic materials.

23. Personal flotation device, comprising:
a) first and second inflatable spheroid balloons;

b) first and second straps directly secured to respective first and second balloons;

c) a leg harness secured to said first and second straps; and d) said first and second straps having sufficient lengths to keep the user's head above water.

24. Personal flotation device as in claim 23, wherein:

a) said leg harness includes first and second loops into which the user's respective legs are slipped; and b) a belt configured to be worn around the user's waist.

25. A method for keeping a person afloat in water, comprising:

a) providing an inflated spheroid balloon having a strap directly secured to the balloon and with a loop attached thereto;

b) slipping the person's arm into the loop.

26. A method for keeping a person afloat in water, comprising:

a) providing an inflated spheroid balloon having a strap directly secured to the balloon and with a loop attached thereto;

b) slipping the person's leg into the loop.

27. A method for keeping a person afloat in water, comprising:

a) providing an inflated spheroid balloon having a strap directly secured to the balloon and with a loop attached thereto;

b) slipping person's upper body into the loop.

28. A method for keeping a person afloat in water, comprising:

a) providing first and second inflated spheroid balloons having a strap with its first and second ends directly secured to the respective first and second balloons;

b) disposing the strap across the person's front upper chest and underneath each armpit such that the balloons are disposed behind the person's shoulders.

29. A method for keeping a person afloat in water, comprising:

a) providing first and second inflated spheroid balloons having a strap with its first and second ends directly secured to the respective first and second balloons;

b) disposing the strap across the person's crotch.

30. Personal flotation device, comprising:

a) an inflatable balloon;

b) a strap with one end directly secured to said balloon;

c) said balloon when deflated and said strap being compact enough to fit in a person's pocket.

31. Personal flotation device as in claim 30 and further comprising a pouch for storing said balloon when deflated and said strap in a person's pocket.

32. Personal flotation device as in claim 30, wherein said strap includes a loop into which a person's arm, leg or upper body may be slipped.

33. Personal flotation device as in claim 30, wherein said balloon is a spheroid.

34. Personal flotation device as in claim 30, and further comprising another balloon secured to a free end of said strap.

* * * * *